US009082538B2

(12) United States Patent
Yan et al.

(10) Patent No.: US 9,082,538 B2
(45) Date of Patent: Jul. 14, 2015

(54) SINTERED ND—FE—B PERMANENT MAGNET WITH HIGH COERCIVITY FOR HIGH TEMPERATURE APPLICATIONS

(75) Inventors: Mi Yan, Hangzhou (CN); Xiangzhi Zhou, Hangzhou (CN); Xiongfei Fan, Dongyang (CN); Tianyu Ma, Hangzhou (CN); Wei Luo, Hangzhou (CN)

(73) Assignees: ZHEJIANG UNIVERSITY, Hangzhou (CN); ZHEJIANG INNUOVO MAGNETICS INDUSTRY CO., LTD, Dongyang (CN)

( * ) Notice: Subject to any disclaimer, the term of this patent is extended or adjusted under 35 U.S.C. 154(b) by 0 days.

(21) Appl. No.: 13/132,222

(22) PCT Filed: Dec. 1, 2008

(86) PCT No.: PCT/CN2008/073270

§ 371 (c)(1),
(2), (4) Date: Jun. 1, 2011

(87) PCT Pub. No.: WO2010/063142

PCT Pub. Date: Jun. 10, 2010

(65) Prior Publication Data

US 2011/0233455 A1 Sep. 29, 2011

(51) Int. Cl.
*H01F 1/057* (2006.01)
*H01F 41/02* (2006.01)

(52) U.S. Cl.
CPC ..... *H01F 1/0577* (2013.01); *H01F 41/0266* (2013.01)

(58) Field of Classification Search
CPC ..... H01F 1/0577; H01F 41/0293
USPC ..... 148/302
See application file for complete search history.

(56) References Cited

U.S. PATENT DOCUMENTS 5,803,992 A * 9/1998 McCallum et al. ..... 148/302
5,858,124 A * 1/1999 Endo et al. ..... 148/302

(Continued)

FOREIGN PATENT DOCUMENTS

CN 1725394 1/2006
CN 101055779 10/2007

(Continued)

OTHER PUBLICATIONS

Merkulova et al., "The Temperature Dependence of Coercivity in Nanocrystalline Nd—Fe—B—(TiC) Magnets", Journal of Applied Physics, vol. 87, No. 9, (May 2000), pp. 4738-4740.*

(Continued)

*Primary Examiner* — Jie Yang
*Assistant Examiner* — Xiaowei Su
(74) *Attorney, Agent, or Firm* — Hamre, Schumann, Mueller & Larson, P.C.

(57) ABSTRACT

A type of sintered Nd—Fe—B permanent magnet with high intrinsic coercivity of about 30KOe or more is produced by dual alloy method. The method comprises the following steps: preparing the powders of master phase alloy and intergranular phase alloy respectively, mixing the powders, compacting the powders in magnetic field, sintering the compacted body at 1050~1125° C. and annealing at 890-1000° C. and 500-650° C. successively. In the process of preparing the powder of intergranular phase alloy, the nano-powder additive selected from the group consisting of NiAl, TiC, SiC, AlN, TiN, ZrN and the combination thereof is used to modify the powder of intergranular phase alloy.

4 Claims, 4 Drawing Sheets

(56) References Cited

U.S. PATENT DOCUMENTS

| | | | | |
|---|---|---|---|---|
| 2006/0137767 | A1* | 6/2006 | Yamamoto et al. | 148/302 |
| 2007/0071979 | A1* | 3/2007 | Komuro et al. | 428/403 |
| 2010/0051139 | A1* | 3/2010 | Nagata et al. | 148/101 |
| 2011/0234350 | A1* | 9/2011 | Yan et al. | 335/302 |

FOREIGN PATENT DOCUMENTS

| | | |
|---|---|---|
| CN | 101178963 | 5/2008 |
| EP | 1843360 | 10/2007 |
| JP | 5013207 | 1/1993 |

OTHER PUBLICATIONS

Machine translation of CN101178963A, May 2008.*
Machine translation of CN 101055779A, Oct. 2007.*
Machine translation of CN 1725394A, Jan. 2006.*
International Search Report for PCT/CN2008/073270, dated Sep. 10, 2009 (2 pages total).

* cited by examiner

SINTERED ND—FE—B PERMANENT MAGNET WITH HIGH COERCIVITY FOR HIGH TEMPERATURE APPLICATIONS

FIELD OF THE INVENTION

The present invention relates to a sintered Nd—Fe—B permanent magnet with high coercivity for high temperature applications.

BACKGROUND OF THE INVENTION

Nd—Fe—B magnets have been recently developed as the leading RE permanent magnets with the highest room temperature magnetic properties beneficial for the wide use. The experimental value of the energy product of sintered Nd—Fe—B reached 59.5MGOe about 93% of the theoretic value and the remanence reached about 96% of the theoretic value in 2006, which was attained through the conventional single-alloy powder metallurgy method. Total weight of the 2007 production of Nd—Fe—B sintered magnets probably reached 58000 metric tones.

However, Nd—Fe—B permanent magnet materials have extremely poorer thermal stability than conventional Sm—Co permanent magnets. The coercivity of the magnet with highest energy product is as low as 8.2 kOe. Thus, they have suffered from the problems that they cannot be assembled in automobiles or precious devices appliances, and that they cannot be used in high temperature environments.

In order to make Nd—Fe—B sintered magnets more useful in a wider variety of applications at high temperature, the higher coercivity is essential. Because of the consequence of this, deficiency is reflected in the temperature coefficient of $B_r$ (remnant magnetism) and $H_{ci}$ (intrinsic coercivity), especially in the latter.

To address these problems, numerous researches have been carried out to improve their operating temperature. The elements addition is an effective approach, two types of substituent elements (S1, S2), which replace the rare-earth element (S1=Dy, Tb) or the transition element sites (S2=Co, Ni, Cr) in the hard magnetic phase, and two types of dopant elements (M1, M2) are distinguished. Substituent elements mainly change the intrinsic properties, such as spontaneous magnetic polarization, Curie temperature, and magnetocrystalline anisotropy. Both types of dopant elements influence the microstructure in a different way. M1 (Al, Cu, Zn, Ga, Ge, Sn) form binary M1-Nd or ternary M1-Fe—Nd phases, M2 (Ti, Zr, V, Mo, Nb, W) form binary M2-B or ternary M2-Fe—B phases.

Those efforts can affect the properties by changing the intrinsic behaviour of the matrix phase or improving the microstructure or both. In many instances, some properties of the sintered characteristics of the ternary Nd—Fe—B system are commonly improved but by sacrificing other properties. The reason is that one or several of the intrinsic magnetic properties of the matrix phase are impaired when these elements are dissolved in the matrix phase.

Based on the argumentation, it is necessary to find a method (or alloy) for improving the thermal stability ($T_c$ and $H_{ci}$) without impairing the magnetic performance ($B_r$ (remnant magnetism) and $(BH)_{max}$ (magnetic energy production)).

SUMMARY OF THE INVENTION

The main object of the present invention is to provide an anisotropic sintered Nd—Fe—B permanent magnet having improved intrinsic coercivity suitable for high temperature applications by varying the chemical composition and optimizing the microstructure of magnets.

Another object of the invention is to develop a method of manufacturing a magnet which improves not only the thermal stability ($H_{ci}$ and $T_c$) of the Nd—Fe—B magnet but also the $B_r$ and $(BH)_{max}$. The magnet is produced by two-alloy method (binary powder blending technique), wherein the powders of intergranular-phase thereof are modified by nano-powders to obtain preferred intergranular morphologies and make the microstructures of magnets as refined as possible, so as to be distinguished from conventional two alloy method.

A remarkable improvement in coercivity is observed in modified magnet showing a peak value at 10 wt % intergranular-phase alloy addition. There is a slight increase in density at small amount of 5~10 wt % nano-powders modified intergranular-phase alloy (FIG. 1(*b*)).

Figure 2:
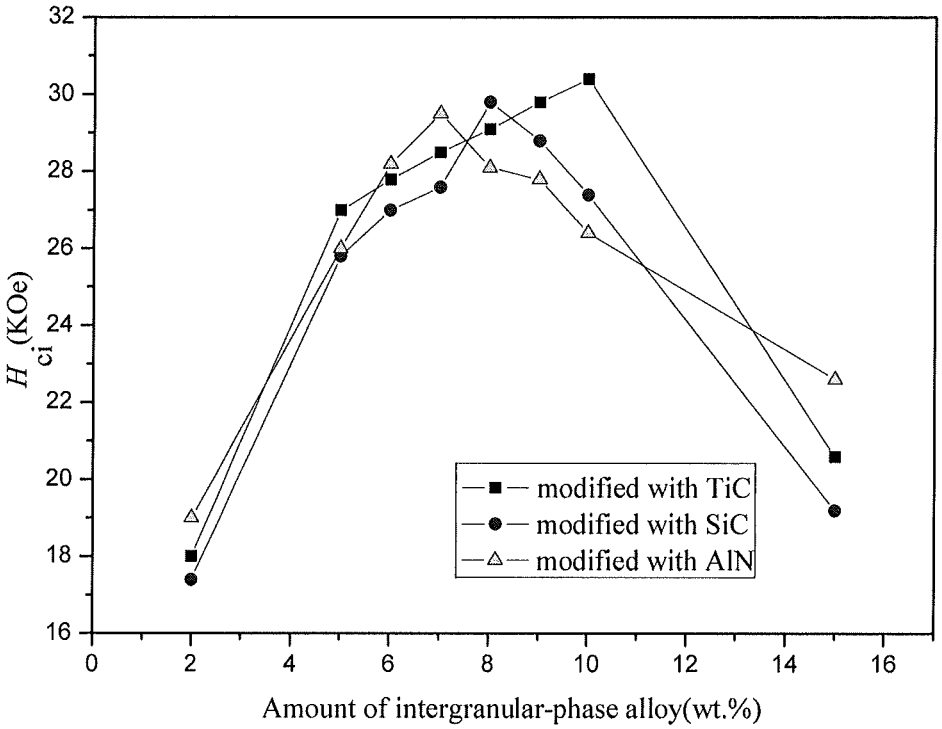

FIG. 2 is a graph showing the coercivity $H_{ci}$ of magnets as a function of modified intergranular-phase alloy. The intergranular-phase powders are modified by 1 wt % TiC, SiC, AlN 1 nm powders. The magnets prepared with modified intergranular-phase powders exhibited high coercivity of about 30KOe or more having modified intergranular-phase powders at small amount of 5~10 wt %.

Figure 3:
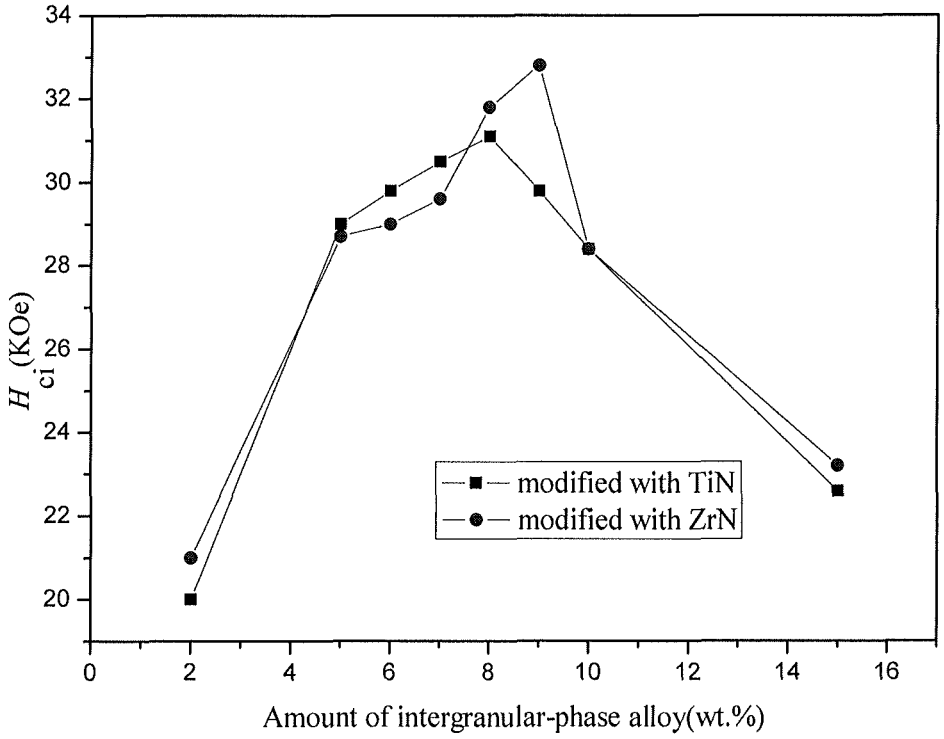

FIG. 3 is a graph showing the coercivity $H_{ci}$ of magnets as a function of modified intergranular-phase alloy. The intergranular-phase powders are modified by 0.2 wt % TiN, ZrN 40 nm powders. The magnets prepared with modified intergranular-phase powders exhibited high coercivity of about 30KOe or more having modified intergranular-phase powders at small amount of 5~10 wt %.

Figure 4:
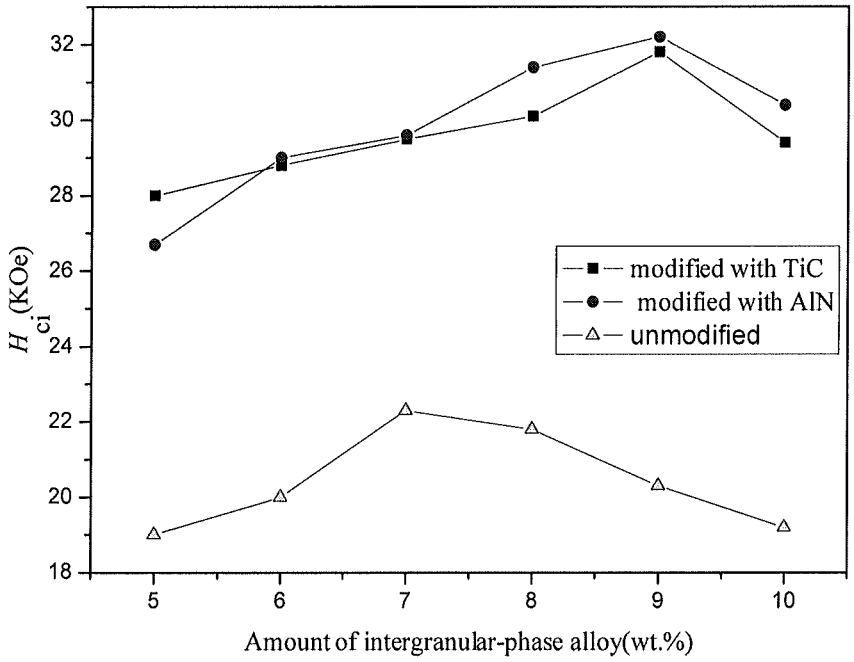

FIG. 4 is a graph showing the coercivity $H_{ci}$ of magnets as a function of modified intergranular-phase alloy. The intergranular-phase powders are modified by 0.05 wt % TiC, AlN 20 nm powders. The magnets prepared with modified intergranular-phase powders exhibited high coercivity of about 30KOe or more having modified intergranular-phase powders at small amount of 5~10 wt %. Also, the magnets prepared with modified intergranular-phase powders exhibited higher coercivity than the magnet prepared with unmodified intergranular-phase powders at small amount of 5~10 wt %.

DETAILED DESCRIPTION OF THE INVENTION

The intergranular-phase alloy powders used in this invention are modified by very small addition of nano-powders with average particle size of 1~60 nm which are selected from the group consisting of NiAl, TiC, SiC, AlN, TiN, ZrN and their combination thereof. These nano-powders afford a variety of excellent characteristic performances such as high melting point, low-density, low thermal conductivity and antioxidation properties.

The main processing methods of the present invention include alloy melting, strip casting, mechanically ball milling, hydrogen decrepitation, jet milling. The homogenous mixture of the required powders obtained is subsequently aligned in a magnetic field, then compressed under pressure, followed by sintering and tempering, to obtain final product of the magnets. The magnetic properties of the magnets are measured by AMT-4 magnetic measurement. The microstructures and components of the sintered magnets were analyzed by scanning electron microscope (SEM) equipped with energy dispersive X-ray detector (EDX).

The results showed that the sintered permanent magnet of the present invention has high coercivity $H_{ci}$ of about 30KOe or more, which is illustrated in the figures. There is an evident increase in density of the magnetic after being modified by adding nano-powder additive. Further micro-analysis shows that there is fine and uniform $Nd_2Fe_{14}B$ main phase grains which is substantially spherical existing in these magnets modified by nano-powder additive, with an average size of approximately 5~6 μm which is much smaller than that of the conventional unmodified magnet with an average size of approximately 8~9 μm. Modified magnet has small, regular shaped grain boundaries, and most grains of its master-phase isolate from each other for they are covered by a layer of even Nd-rich film with a thickness of around 2 nm, wherein the thin layer weakens the exchange couple demagnetization effect between grains. Further analysis shows that the nano-powder additives or high-melting particles become pinning points in the border region of the 2-14-1 phase and hinder the abnormal grain growth. This kind of microstructures could contribute to the improvement of the intrinsic coercivity of the magnet.

Other and further advantages, features and benefits of the magnet of the present invention are illustrated in the following drawings and exemplary embodiments.

EXAMPLES

Example 1

1) The master-phase and intergranular-phase alloys were prepared respectively. Strip flakes are prepared by the strip casting technique. The melted master-phase alloy is ejected onto a spinning copper wheel with speed 1.2 m/s, the composition is, by atomic percent, $Nd_{13.12}Fe_{80.69}B_{5.73}(Dy_{0.22}Al_{0.24})$. The melted intergranular-phase alloy is ejected onto a spinning copper wheel with speed 18 m/s, the composition is, by atomic percent, $Nd_{17.2}Fe_{75.58}B_{6.38}Dy_{0.64}Ga_{0.2}$.

2) The master-phase and intergranular-phase powders were prepared respectively. The powers were prepared by using jaw-crusher as coarse crushing and followed medium crushing by using medium-crusher. Subsequently, the master-phase alloy was made into powders with average particle diameter 3.0 μm and the intergranular-phase with average particle diameter 1.0 μm by jet milling in nitrogen condition.

3) Mixed the intergranular-phase powders and 0.01 wt % NiAl powders with average particle size of 60 nm well-proportioned with 3 wt % monohexadecyl ether as antioxidant and 2 wt % oleic acid as lubricant in a mixer.

4) The mixture powders were prepared by mixing the master-phase alloy powders with 2~15 wt % intergranular-phase alloy powders modified by NiAl nano-powder and 1 wt % gasoline in blender mixer. Synchronously, the mixture powers were prepared by mixing the master-phase alloy powers with 5~10 wt % unmodified intergranular-phase alloy powders and 1 wt % gasoline in blender mixer.

5) The mixture powers were compacted and aligned in a magnetic field of 1.2 T. The green compacts were pressed in a completely sealed glove box to insulate magnetic powers from air.

6) The green compacts were sintered in a high vacuum sintering furnace of $10^{-4}$ pa at temperature 1050° C. for 3 h and then annealed at temperature 890° C. for 3 h then 500° C. for 3 h followed by rapidly cooling rate of 200° C./min to room temperature. Finally, the finished sintered magnets were obtained.

Figure 1:
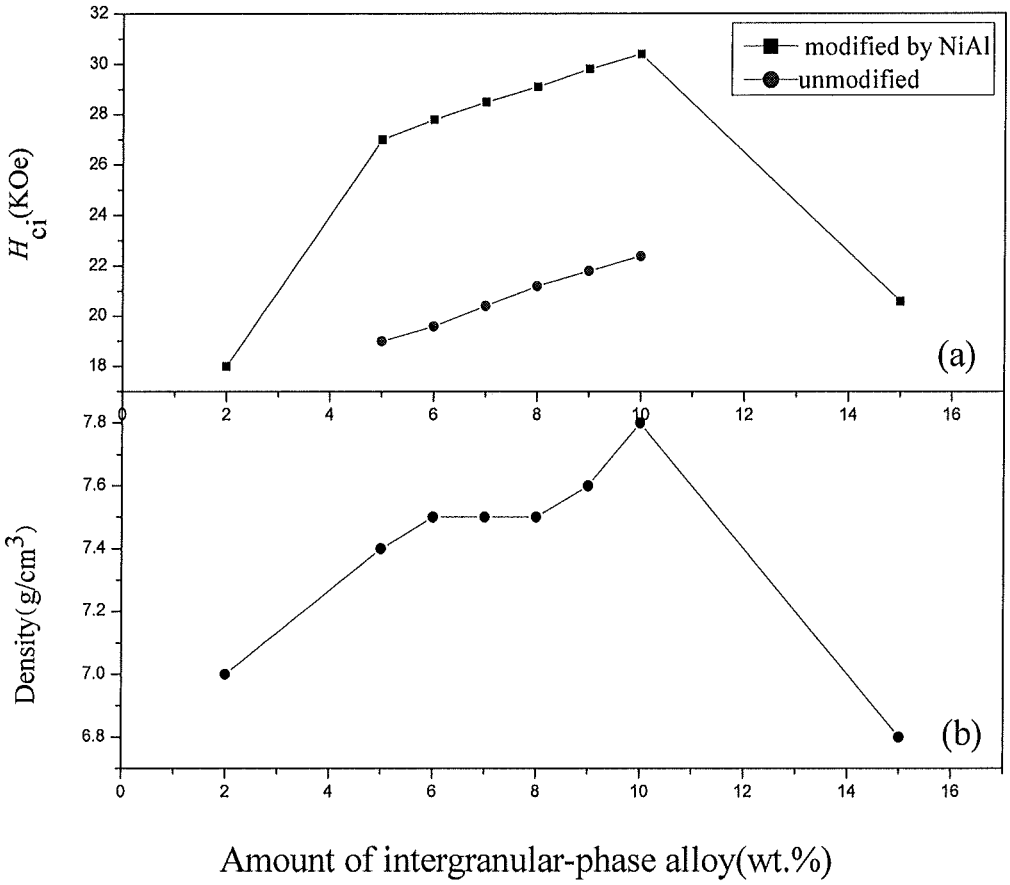
FIG. 1 is a graph showing the coercivity $H_{ci}$ (a) and sintered density (b) of magnets as a function of modified and unmodified intergranular-phase alloy. The intergranular-phase powders are modified by 0.01 wt % NiAl 60 nm powders. The magnets prepared with modified intergranular-phase powders exhibited higher coercivity than the magnet prepared with unmodified intergranular-phase powders at small amount of 5~10 wt %.

Density was measured by Archimedes' method. The magnetic properties of the magnets were measured by AMT-4 measurement as shown in FIG. 1.

Example 2

1) The master-phase and intergranular-phase alloys were prepared respectively. Strip flakes were prepared by the strip casting technique. The melted master-phase alloy was ejected onto a spinning copper wheel with speed 2.0 m/s, the composition was, by atomic percent, $Nd_{14.2}Fe_{77.15}B_{5.82}(Tb_{0.31}Al_{0.24}Co_2Nb_{0.28})$. The melted intergranular-phase alloy was ejected onto a spinning copper wheel with speed 18 m/s, the composition was, by atomic percent, $Nd_{16.7}Fe_{75.27}B_{6.31}(Dy_{1.2}Ga_{0.2}Al_{0.32})$.

2) The master-phase and intergranular-phase powders were prepared respectively. The powders were prepared by HDDR process during which the alloy was hydrogenised to saturation at room temperature and then dehydrogenated into powers at 500° C. for 8 h. Subsequently, the master-phase alloy was made into powders with average particle diameter 4 μm and the intergranular-phase with average particle diameter 2 μm by jet milling in nitrogen condition.

3) Mixed the intergranular-phase powders and 1 wt % TiC, SiC or AlN powders with average particle size of 1 nm well-proportioned with 4 wt % poly-oxacyclopropane fatty acid ester as antioxidant and 3 wt % polyethylene glycol as lubricant in a mixer.

4) The mixture powders were prepared by mixing the master-phase alloy powers with 2~15 wt % intergranular-phase alloy powers modified by TiC, SiC or AlN nano-powders and 1.2 wt % gasoline in blender mixer.

5) The mixture powders were compacted and aligned in a magnetic field of 1.4 T. The green compacts were pressed in a completely sealed glove box to insulate magnetic powers from air.

6) The green compacts were sintered in a high vacuum sintering furnace of $10^{-4}$ pa at temperature 1065° C. for 3 h and then annealed at temperature 960° C. for 2 h then 530° C. for 2.5 h followed by rapidly cooling rate of 300° C./min to room temperature. Finally, the finished magnets were obtained.

The magnetic properties of the magnets were measured by AMT-4 measurement as shown in FIG. 2.

Example 3

1) The master-phase and intergranular-phase alloys were prepared respectively. Strip flakes were prepared by the strip casting technique. The melted master-phase alloy was ejected onto a spinning copper wheel with speed 2.2 m/s, the composition was, by atomic percent, $Nd_{11.56}Fe_{81.55}B_{5.9}Dy_{0.99}$. The melted intergranular-phase alloy was ejected onto a spinning copper wheel with speed 18 m/s, the composition was, by atomic percent, $Nd_{27.83}Fe_{56.2}B_{6.68}Dy_{2.47}Co_{6.82}$.

2) The master-phase and intergranular-phase powders were prepared respectively. The powders were prepared by using jaw-crusher as coarse crushing and followed medium crushing by using medium-crusher. Subsequently, the master-phase alloy was made into powers with average particle diameter 5 μm and the intergranular-phase with average particle diameter 3 μm by jet milling in nitrogen condition.

3) Mixed the intergranular-phase powders and 0.2 wt % TiN or ZrN powders with average particle size of 40 nm well-proportioned with 4 wt % monohexadecyl ether as antioxidant and 4 wt % dehydrate sorbitan as lubricant in a mixer.

4) The mixture powers were prepared by mixing the master-phase alloy powers with 2~15 wt % intergranular-phase alloy powers modified TiN or ZrN nano-powders and 2 wt % gasoline in blender mixer.

5) The mixture powders were compacted and aligned in a magnetic field of 1.8 T. The green compacts were pressed in a completely sealed glove box to insulate magnetic powers from air.

6) The green compacts were sintered in a high vacuum sintering furnace of $10^{-4}$ pa at temperature 1085° C. for 4.5 h and then annealed at temperature 900° C. for 2 h then 560° C. for 4 h followed by rapidly cooling rate of 100° C./min to room temperature. Finally, the finished magnets were obtained.

The magnetic properties of the magnets were measured by AMT-4 measurement as shown in FIG. 3.

Example 4

1) The master-phase and intergranular-phase alloys were prepared respectively. Strip flakes were prepared by the strip casting technique. The melted master-phase alloy was ejected onto a spinning copper wheel with speed 1.5 m/s, the composition was, by atomic percent, $Nd_{12.69}Fe_{80.21}B_{5.7}Dy_{1.4}$. The melted intergranular-phase alloy was ejected onto a spinning copper wheel with speed 18 m/s, the composition was, by atomic percent, $Nd_{23.74}Fe_{64.78}B_{6.88}(Dy_{0.92}Co_{1.27}C_{0.35}Nb_{0.4}Al_{1.66})$.

2) The master-phase and intergranular-phase powders were prepared respectively. The powers were prepared by HDDR process during which the alloy was absorbed hydrogen to saturation at room temperature and then dehydrogenated into powers at 500° C. for 8 h. Subsequently, the master-phase alloy was made into powers with average particle diameter 6 μm and the intergranular-phase with average particle diameter 4 μm by jet milling in nitrogen condition.

3) Mixed the intergranular-phase powders and 0.05 wt % TiC or AlN powders with average particle size of 20 nm well-proportioned with 8 wt % poly-oxacyclopropane fatty acid ester as antioxidant and 3 wt % polyethylene glycol as lubricant in a mixer.

4) The mixture powers were prepared by mixing the master-phase alloy powers with 5~10 wt % intergranular-phase alloy powers modified by TiC or AlN nano-powders and 3.4 wt % gasoline in blender mixer. Synchronously, the mixture powers were prepared by mixing the master-phase alloy powers with 5~10 wt % unmodified intergranular-phase alloy powers and 3.4 wt % gasoline in blender mixer.

5) The mixture powders were compacted and aligned in a magnetic field of 1.6 T. The green compacts were pressed in a completely sealed glove box to insulate magnetic powers from air.

6) The green compacts were sintered in a high vacuum sintering furnace of $10^{-4}$ pa at temperature 1080° C. for 3 h and then annealed at temperature 1000° C. for 2 h then 650° C. for 3 h followed by rapidly cooling rate of 400° C./min to room temperature. Finally, the finished magnets were obtained.

The magnetic properties of the magnets were measured by AMT-4 measurement as shown in FIG. 4.

We claim that:

1. A sintered Nd—Fe—B permanent magnet, comprising:

(A) 90~95 wt % of a master-phase alloy powder, by weight of the permanent magnet, wherein the master-phase alloy powder comprises 11~16% of Nd, 5.4~6.6% of B, 0~6% of M and a balance of Fe by atomic percent, wherein M is at least one selected from the group consisting of Dy, Tb, Nb, Co, Ga, Zr, and Al; and (B) 5~10 wt % of an intergranular-phase alloy powder, by weight of the permanent magnet, wherein the intergranular-phase alloy powder is modified by a nano-powder additive before being sintered to form the sintered Nd—Fe—B permanent magnet, the nano-powder additive is at least one selected from the group consisting of NiAl, TiC, SiC, AlN, TiN, and ZrN, the intergranular-phase alloy powder before being modified comprises 13.5~30% of Nd, 4~7% of B, 0~15% of R and a balance of Fe by atomic percent, where R is at least one selected from the group consisting of Dy, Tb, Nb, Co, Ga, Zr, Cu, Al, and Si, the sintered Nd—Fe—B permanent magnet is obtained by a two-alloy method, the intergranular-phase alloy powder is modified by an amount of the nano-powder additive sufficient so that the sintered Nd—Fe—B permanent magnet has an intrinsic coercivity of about 30KOe or more, and the amount of the nano-powder additive is 0.01~1% by weight of the intergranular-phase alloy powder.

2. The magnet of claim 1, wherein the nano-powder additive has an average particle size of 1~60 nm.

3. The magnet of claim 1, wherein the magnet is obtained by:

preparing the master-phase alloy powder with a particle size of 3-8 μm;

preparing the intergranular-phase alloy powder with a particle size of 1-4 μm, and modifying with a predetermined amount of the nano-powder additive;

mixing the master-phase alloy powder and the intergranular-phase alloy powder that is modified by the nano-powder additive to form a well-proportioned mixture;

compacting said well-proportioned mixture in a magnetic field of 1.2-2.0 T to form a compacted body, sintering the compacted body at a temperature of 1050-1125° C. in a high vacuum sintering furnace of $10^{-3}$-$10^{-4}$ pa to form a sintered body;

heating the sintered body at a temperature of 890-1000° C. for 2-4 hours followed by slowly cooling at a cooling rate of 1-4° C./min to room temperature; and heating the cooled sintered body at a temperature of 500-650° C. for 2-4 hours followed by rapidly cooling at a cooling rate of 100-400° C./min, to form the Nd—Fe—B permanent magnet.

4. The magnet of claim 1, wherein the magnet includes main phase grains that are substantially spherical with an average size of about 5 μm to about 6 μm.

* * * * *